US012759672B2

(12) United States Patent
Jones

(10) Patent No.: US 12,759,672 B2
(45) Date of Patent: Oct. 13, 2026

(54) DEVICE FOR TOWING A WATERCRAFT

(71) Applicant: Timothy Leonard Jones, Austin, TX (US)

(72) Inventor: Timothy Leonard Jones, Austin, TX (US)

( * ) Notice: Subject to any disclaimer, the term of this patent is extended or adjusted under 35 U.S.C. 154(b) by 628 days.

(21) Appl. No.: 18/123,821

(22) Filed: Mar. 20, 2023

(65) Prior Publication Data

US 2023/0227129 A1 Jul. 20, 2023

Related U.S. Application Data

(63) Continuation-in-part of application No. 17/818,216, filed on Aug. 8, 2022, now abandoned.

(60) Provisional application No. 63/230,780, filed on Aug. 8, 2021.

(51) Int. Cl.
*B63B 21/56* (2006.01)
*B63H 21/12* (2006.01)

(52) U.S. Cl.
CPC ..... *B63B 21/56* (2013.01); *B63H 21/12* (2013.01)

(58) Field of Classification Search
CPC ..... B63B 21/00; B63B 21/12; B63B 21/56
USPC ..... 114/55.5, 242
See application file for complete search history.

(56) References Cited

U.S. PATENT DOCUMENTS 6,182,594 B1 * 2/2001 Wilson ..... B63B 34/54 441/67
6,295,943 B1 10/2001 Brushaber
7,096,811 B2 8/2006 Clarke et al.
7,371,136 B2 5/2008 Hine et al.
8,311,595 B2 11/2012 Takatsuka et al.
10,011,327 B2 * 7/2018 Sato ..... B63B 34/10
(Continued)

FOREIGN PATENT DOCUMENTS

KR 101507479 3/2015
KR 20210051841 5/2021
(Continued)

OTHER PUBLICATIONS

California Polytechnic State University; Surface Autonomous Vehicle for Emergency Rescue; https://digitalcommons.calpoly.edu/cgi/viewcontent.cgi?article=1686&context=mesp; Jun. 3, 2021.
(Continued)

*Primary Examiner* — Lars A Olson
(74) *Attorney, Agent, or Firm* — Outlier Patent Attorneys, PLLC

(57) ABSTRACT

A device for towing a watercraft is disclosed. The device comes in a box-like structure such as a lunch box, tackle-box or cooler. The device connects to the watercraft via a cable. The watercraft includes an inner tube, a stand-up paddle board, a kayak, etc. The device stores personal items and electronic components. The device includes a propulsion system for providing thrust force to propel the device in a given direction. The device tows the watercraft with or without a user on it in the given direction and speed defined by the user. The device includes a transceiver for receiving instructions wirelessly from an electronic device operated by the user. The device allows the user to stand or sit on the watercraft and perform a variety of activities such as photography, eating, communicating, etc. while being towed.

21 Claims, 4 Drawing Sheets

(56) References Cited

U.S. PATENT DOCUMENTS

| | | | | |
|---|---|---|---|---|
| 10,040,518 | B1 * | 8/2018 | Matsuda | B63B 34/10 |
| 10,160,523 | B2 | 12/2018 | Teppig, Jr. et al. | |
| 10,362,773 | B2 | 7/2019 | Caprioli | |
| 11,358,511 | B1 | 6/2022 | Metellus et al. | |
| 2009/0316526 | A1 | 12/2009 | Grall | |
| 2011/0088607 | A1 * | 4/2011 | Kobayashi | B63B 34/10 114/55.57 |
| 2019/0031299 | A1 | 1/2019 | Bangslund et al. | |

FOREIGN PATENT DOCUMENTS

| | | |
|---|---|---|
| PT | 2704946 E | 6/2015 |
| WO | 2012104565 | 8/2012 |
| WO | 2020003224 | 1/2020 |

OTHER PUBLICATIONS

Liquid Robotics Inc; Model 08 Wave Glider™; http://icefloe.net/cruise_docs/hly1403/data/RDC/Data_2014/USV-Brian/General%20Information/Wave_Glider_User_Manual.pdf; Mar. 14, 2011. [no longer available].

Liquid Robotics; Customer Training Guide Pre-Launch Wave Glider® SV3; Part No. 08033, Revision A; Jun. 2016.

* cited by examiner

DEVICE FOR TOWING A WATERCRAFT

RELATED APPLICATIONS

This application is a claims benefit to the following provisional and non-provisional applications, which are here expressly incorporated herein by reference:

U.S. Provisional Patent Application No. 62/339,513 entitled, "LUNCH BOX TOW DEVICE" filed on Aug. 8, 2021; and U.S. Non-Provisional patent application Ser. No. 17/818,216 entitled, "WATER PROPULSION DEVICE FOR LINKING TO WATER FLOTATION CRAFT AND COMMUNICATING WITH A MOBILE DEVICE, AND METHODS OF OPERATION" filed on Aug. 8, 2022.

FIELD OF THE INVENTION

The present invention generally relates to towing devices. More particularly, the present invention relates to a device that floats in water and tows a watercraft.

DESCRIPTION OF THE RELATED ART

It is known that people take up water sports as a recreation activity for exercise and/or relaxation. The water sports can be taken up individually or in groups. Generally, each person is responsible for his/her own watercraft/craft and supplies, but groups of people also desire to navigate or stay within proximity of each other. An example of the watercraft includes, but not limited to, a stand up paddle board, an inner tube, a kayak, a boat, a ship, a hovercraft, a Personal Watercraft (PWC), etc. The boat further includes a raft, a gondola, a kayak, a canoe, an inflatable tube, a sailboat, etc. When navigating rivers, lakes or other bodies, a person on the watercraft may traverse both areas of relative calm, and areas of activity such as waterfalls, rapids, waves, etc. These different areas reflect the relative movement of the water whether it is moving slowly and peacefully or more violently; and also reflect the amount of input required to move the craft relative to the water.

The PWCs are usually light weight and carried by hand. It is often the case that parking is somewhat remote from the water destination, and such PWCs need to be carried from a vehicle to the water. In a group, each person manages carrying all his/her own gear, in order for the group to remain together, and to not require multiple trips from the vehicle to the water. Since parking may be at a distance to the water, making multiple trips requires time and effort. In a group of people, making multiple trips also segregates the group.

Propulsion on the PWCs is accomplished by paddles, whether oar type or rotation type; human padding and swimming; kites and sails; propellers attached to engines. Manual propulsion requires carrying extra equipment. This includes any oars, paddles, kites, sails, fins, etc. required to move the vehicle. The space on the PWC is limited, and such equipment must also be attached to the device in some manner to prevent losing them in the water. All such items also have to be transported from the parked vehicle to the water, and doing so in one trip is desired.

Although wheeling a vehicle is convenient on flat ground, often the approach to a body of water is not flat or conducive to wheels. Because water and land interact, the approach is often rocky, muddy, surrounded by vegetation or other obstacles. In addition, wheels add extra weight to the vehicle, such that they usually require being left on land.

This requires an ability for each person to secure their wheels against theft, and in popular spots the ability to distinguish one person's wheels from another.

Not all activity has an emphasis on physical activity. Tubes, kayaks, stand-up paddle boards, canoes and other watercrafts often are used recreationally and in environments where less physical input is more desirable than hard exercise. This might include floating on slow moving rivers or lakes; congregating on the surface of a lake; etc. When there is a current, often a person may desire to stay in a given location regardless of the flow of water exerting a force to move them. Maintaining location against a current using oars, paddles etc. requires constant physical input.

In such cases, the convenience of a gas engine is useful, but many bodies of water prohibit gas engines due to pollution, noise, or other regulations. In addition, gas engines and their required fuel are heavy and generally cannot be carried by hand.

In order to overcome the problems discussed above, several devices have been proposed in the past. One such device is disclosed in a PCT Publication No. 2012104565, entitled "Autonomous floating device and method for slaving the position of a nautical craft" ("the '565 Publication"). The '565 Publication discloses an autonomous floating device (105) for slaving the position of a mobile craft, characterized in that it comprises: a means (150) for determining geographical position, a propulsion member (170), an energy source (160) for powering the propulsion member, a means (165) for orienting the force exerted by the propulsion member, a means (135) for attaching a rope linked to said craft, a means for selecting a geographical zone and means for controlling the propulsion member and the orientation means, which are suitable, as a function of the geographical position of the device, for maintaining the device in said geographical zone.

Another example is disclosed in a Publication of user manual titled "Model 08 Wave Guider" Version 2.5 (through WGMS Release 3.7.2) by Liquid Robotics, Inc™, dated Mar. 14, 2011.

Although the above disclosures are useful, still there is a need for a device capable of propelling a person situated in or on a PWC and navigating the rivers, lakes or other water bodies.

SUMMARY

It is one of the main objects of the present invention to provide a device capable of propelling a person situated in or on a personal watercraft (PWC) and that avoids the drawbacks of the prior art.

It is another object of the present invention to provide a device capable of navigating the PWC safely on bodies of water.

It is another object of the present invention to provide a device capable of providing a storage space for storing a variety of components therein and protecting them from getting wet.

In order to overcome the limitations here stated, the present invention provides a device that floats in water, tows a watercraft and interfaces with a user's mobile phone. The device comes in a box-like structure such as a lunch box, tackle-box or cooler. The device connects to the watercraft mechanically. The watercraft includes an inner tube, a stand-up paddle board, a kayak, etc. The device includes a container and a lid. The container includes an interior for storing personal items and electronic components, such as personal mobile devices. The container stores a battery.

Further, the container includes a propulsion system for providing thrust force to propel the device in a given direction.

The device tows the watercraft with or without a user on it in the given direction and at the speed defined by the user and/or controller. The device includes a transceiver for receiving instructions wirelessly from an electronic device operated by the user. The device allows the user to stand or sit on the watercraft and perform a variety of activities such as photography, eating, communicating, etc. while being towed.

In one advantageous feature of the present invention, the device presents a lunch-box sized recreational tow device for pulling a person on the watercraft along a predetermined or spontaneous path.

In another advantageous feature of the present invention, the device avoids obstacles and prevents the device and/or the watercraft from tangling in tree branches, roots, rocks, logs, other watercraft and other obstacles along the travel path. As such, the device provides navigation and safety by a personal watercraft on bodies of water.

In another advantageous feature of the present invention, the device is small enough to be carried in one hand and can be carried in or on an inner tube, kayak, stand-up paddle board or other personal watercraft. In one example, the device is small enough to be carried inside a backpack.

In yet another advantageous feature of the present invention, the device presents a storage area for personal items and prevents them from getting wet.

In yet another advantageous feature of the present invention, the device includes a propulsion system for providing required propulsion in the water. The propulsion system is designed to produce efficient thrust force when traveling slowly. The device is stable in the water when providing a large amount of thrust to a slow moving object.

In yet another advantageous feature of the present invention, the device is attached to whatever it is towing by a cable, cord, rope, line, wire, etc. These connections such as the cable can be stored inside the device. The cable auto-retracts into the device and in some implementation incorporates electrical signals to control the direction of thrust.

In yet another advantageous feature of the present subject matter, the device can push a watercraft and keep the craft moving in the correct direction without a tether or cable.

In yet another advantageous feature of the present subject matter, the device communicates and interfaces with one or more personal mobile devices (such as smart phones) to leverage sensors and software contained on those devices, and communication between them. One or more personal user mobile devices act as the controllers of the presently disclosed device.

In yet another advantageous feature of the present subject matter, the device presents a touch screen interface on its surface that can be used to configure and interact with the device, with any personal mobile device contained within it, with other devices, with network attached services such as maps, messaging, emergency services, drones, manuals, directions, group announcement and resources.

In yet another advantageous feature of the present subject matter, the device can automatically locate itself in relationship to another subject, such as another device, a person, the watercraft it is towing, markers, boundaries, geofences, destinations, other locations in order to prevent separation (i.e. "return to user"), to locate and/or provide directions, to generate a mechanical or proximity connection, to enable further activities.

Features and advantages of the invention hereof will become more apparent in light of the following detailed description of selected embodiments, as illustrated in the accompanying FIGUREs. As will be realized, the invention disclosed is capable of modifications in various respects, all without departing from the scope of the invention. Accordingly, the drawings and the description are to be regarded as illustrative in nature.

BRIEF DESCRIPTION OF THE DRAWINGS

With the above and other related objects in view, the invention consists in the details of construction and combination of parts as will be more fully understood from the following description, when read in conjunction with the accompanying drawings in which.

DESCRIPTION OF THE EMBODIMENTS OF THE INVENTION

Figure 1:
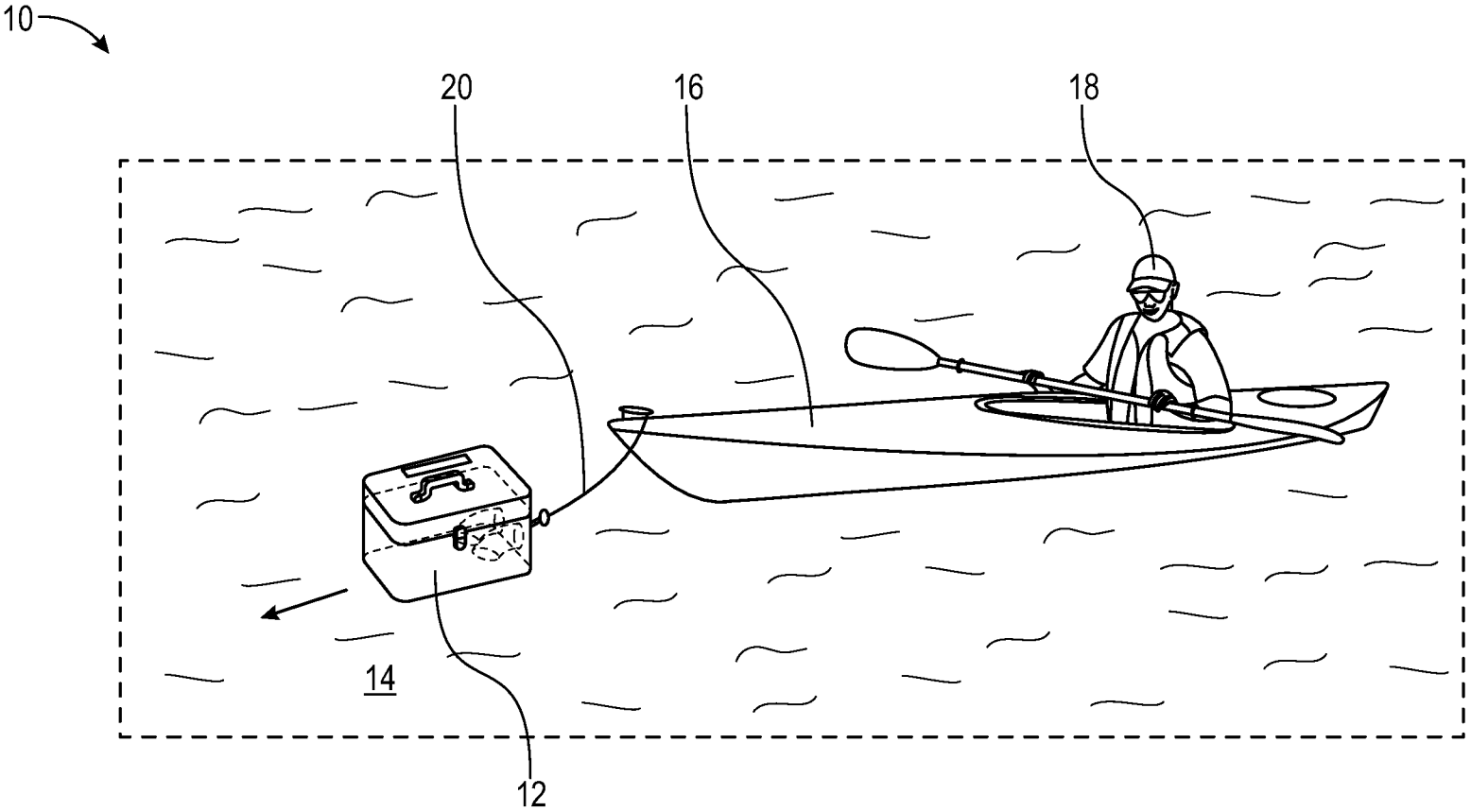
FIG. 1 illustrates an environment in which a device for towing a watercraft implements, in accordance with one embodiment of the present invention.

The following detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed device. However, it will be apparent to those skilled in the art that the presently disclosed invention may be practiced without these specific details. In some instances, well-known structures and devices are shown in functional or conceptual diagram form in order to avoid obscuring the concepts of the presently disclosed device.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present invention provides a description of a device, it is to be further understood that numerous changes may arise in the details of the embodiments of the device. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

The present invention discloses a device for towing a watercraft. The device comes in a box-like structure such as a lunch box, tackle-box or cooler. The device connects to the watercraft via a cable. The device includes a propulsion system for providing thrust force to propel the device in a given direction. The device tows the watercraft with or without a user on it in the given direction and speed defined by the user and/or a controller. The device includes a transceiver for receiving instructions wirelessly from an electronic device operated by the user. The device allows the user to stand or sit on the watercraft and perform a variety of activities such as photography, eating, communicating, etc. while being towed.

Various features and embodiments of a device for towing a watercraft are explained in conjunction with the description of FIGS. 1-8.

Referring to FIG. 1, an environment 10 in which a device 12 implements is shown, in accordance with one exemplary embodiment of the present invention. Device 12 floats in water 14 and pulls a watercraft 16 with or without a user 18 on it via a cable or rope or line 20. An example of watercraft 16 includes an inner tube (tube), a stand-up paddle board, a kayak, a canoe, etc. In the present invention, watercraft 16 indicates a craft that is used recreationally and in environments where less physical input is more desirable than hard exercise. Watercraft 16 floats on slow moving rivers or lakes, congregating on the surface of a lake, etc.

Figure 2:
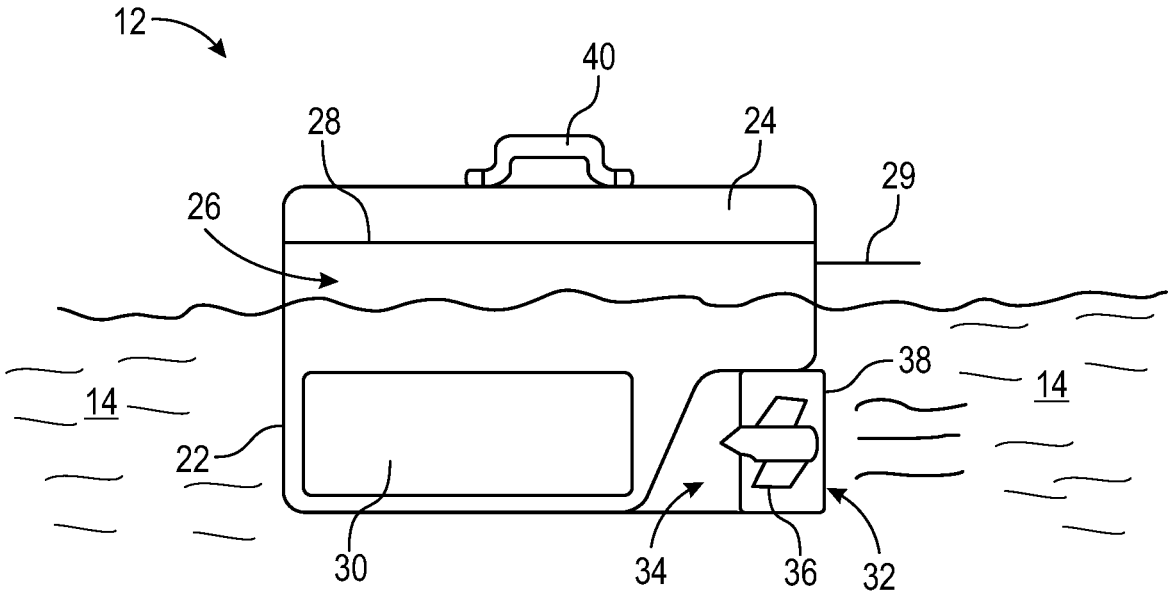
FIGS. 2 and 3 illustrate the device, in accordance with one embodiment of the present invention.
Figure 3:
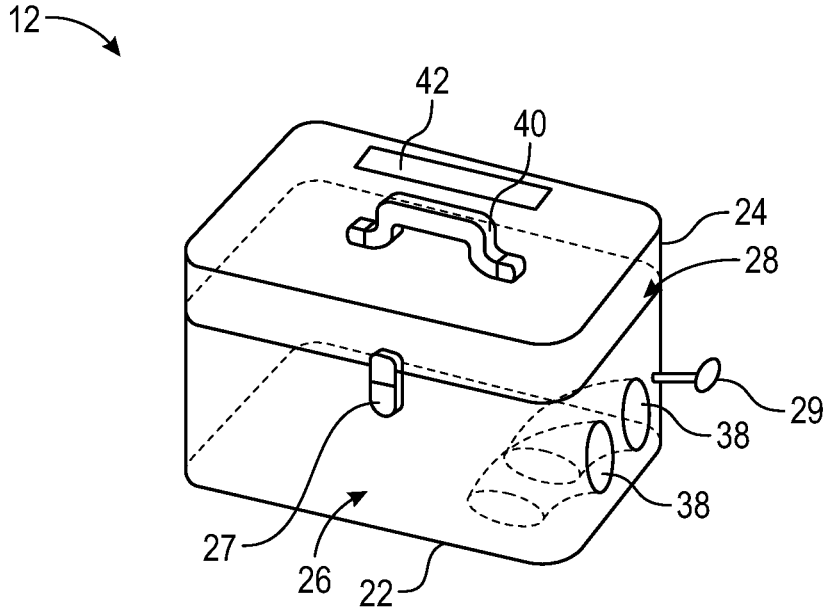

Referring to FIGS. 2 and 3, a front view of device 12 floating or partially submerged in water 14 and a perspective view of device 12, respectively are shown, in accordance with one embodiment of the present invention. Device 12 comes in a box-like structure such as a lunch box, tackle-box or cooler, for example. Device 12 comes in a variety of sizes and shapes depending on the need. Further, device 12 is made of waterproof material. Device 12 floats on water 14. Device 12 has a relatively flat bottom such that device 12 can be placed in watercraft 16 when not in use.

Device 12 includes a container 22 with a lid 24. Container 22 encompasses an interior or opening 26 forming a storage-area for storing (personal) items and/or electronic components for operating device 12. The items include, but not limited to, keys, clothes, mobile phone, food, drinks, wallets, medicines, camera, flags, etc. The bottom edges of container 22 are provided in a smooth configuration such that the size and shape of container 22 does not significantly affect the performance when device 12 is moving in a forward or backward direction. Due to the flat front and smooth edges, water 14 becomes part of device 12 and allows slipstream around device 12. Here, the weight of device 12 and the weight of watercraft 16 with or without user 18 becomes negligible as smooth edges do not cause turbulence/drag in water 14.

Lid 24 connects to container 22 using a hinge (not shown) or any other known mechanism. Lid 24 is made of a suitable material to withstand the environment. In one example, lid 24 is made of a transparent material allowing user 18 to see through the items stored inside container 22. Optionally, lid 24 includes a solar panel for charging a battery 30. Optionally lid 24 includes a touch screen interface. Lid 24 lifts or opens up providing access to interior 26 of container 22. Lid 24 folds or closes over container 22 and restricts access to interior 26 of container 22. In one example, lid 24 encompasses a latch 27. Latch 27 helps to lock lid 24 over container 22, as shown in FIG. 3. In one example, container 22 or lid 24 encompasses a seal 28 for sealing the gap between container 22 and lid 24. Seal 28 ensures there is no gap in between container 22 and lid 24 and prevents water 14 from entering interior 26 containing the items. Further, container 22 encompasses a hook 29, as shown in FIG. 3. Hook 29 connects to cable 20 and helps to pull watercraft 16.

In one implementation, container 22 encompasses a battery 30. Battery 30 includes a rechargeable battery such as Lithium-Ion battery. Battery 30 is used to power the electronic components in device 12. Optionally, battery 30 is used for charging the electronic devices such as the user's mobile phone, speakers, etc. Container 22 includes a propulsion system 32. Propulsion system 32 includes an intake channel 34 for drawing water 14. Propulsion system 32 includes a propulsion member or motor 36 for drawing and pumping out water 14 via an exhaust pipe 38. Motor 36 detectably connects to container 22. In one example, exhaust pipe 38 includes two pipes, as shown in FIG. 3. In one example, two motors 36 are provided for propelling device 12. Motors 36 protrude backwards and position outside of container 22. Motors 36 rotate in opposite directions and keep device 12 stable in water 14. Motors 36 exert linear thrust upon water 14 such that device 12 moves forward or backward (as shown in FIG. 1, for example). In one example, propulsion system 32 includes shrouds, grills, etc. to protect fingers and toes, from drawing in plants or other undesirable material into intake channel 34. In one exemplary embodiment, propulsion system 32 is removably attached to container 22. Propulsion system 32 is removed and stored inside container 22 when not in use.

Further, lid 24 encompasses a handle or strap 40 at the top for easy carrying of device 12. Although it is shown that handle 40 positions at the top of lid 24, a person skilled in the art understands that it is possible to provide handle 40 at any side of lid 24 or container 22 without departing from the scope of the present invention. Handle 40 helps user 18 to carry device 12. Lid 24 includes a display 42. Display 42 is protected to prevent contact from water 14. In one example, display 42 includes a touchscreen display and allows user 18 to set and control operation of device 12.

Figure 4:
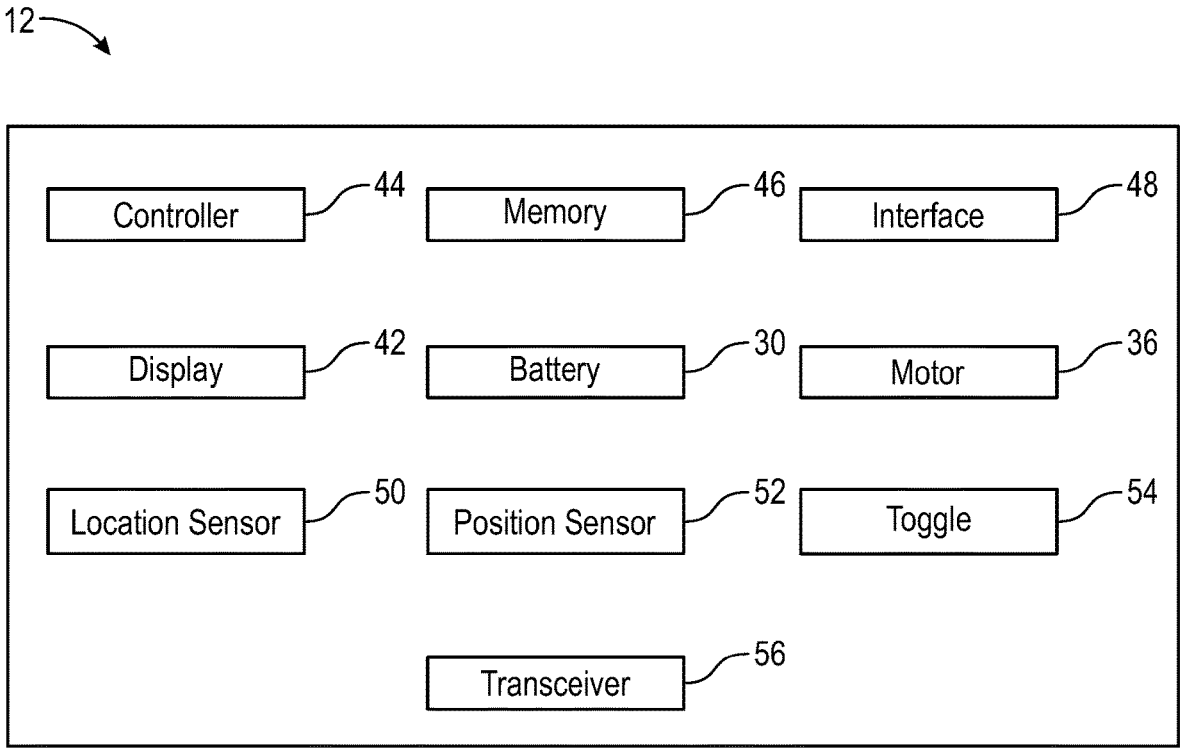
FIG. 4 illustrates a block diagram of the device, in accordance with one embodiment of the present invention.

FIG. 4 shows a block diagram of device 12, in accordance with one embodiment of the present invention. Device 12 includes electronic components positioned in container 22 for controlling the operation of device 12. It should be understood that battery 30, motor 36 and display 42 are part of the electronic components of device 12, as shown in FIG. 4. The electronic components include a controller 44 and a memory 46. Controller 44 indicates a processor such as a Central Processing Unit (CPU), microprocessor or microcontroller. It should be understood that controller 44 is responsible for implementing specific functions under the control of software including an operating system, and any appropriate applications software. Memory 46 includes a volatile memory (e.g., RAM), non-volatile memory (e.g., disk memory, FLASH memory, EPROMs, etc.), unalterable memory, and/or other types of memory. In one implementation, memory 46 stores data, program instructions. The program instructions might control the operation of an operating system and/or one or more applications.

Further, device 12 includes an interface 48. Interface 48 includes wired interfaces and/or wireless interfaces. In one implementation, interface 48 includes functionality similar to at least a portion of functionality implemented by one or more computer system interfaces such as those described herein and/or generally known to one having ordinary skill in the art.

Further, device 12 optionally includes a location sensor 50. Location sensor 50 includes a Global Positioning System (GPS) sensor capable of determining accurate location of device 12. Device 12 optionally includes a position sensor 52. Position sensor 52 indicates a direction or orientation sensor capable of determining accurate position or facing of device 12. In one implementation, device 12 includes a toggle 54. Toggle 54 includes a mechanical or electrical controller such as a joystick capable of controlling the direction and speed of device 12 on water 14.

Furthermore, device 12 includes a wireless communication module/transceiver 56. Transceiver 56 configures to communicate with external devices such as a server (not shown), additional instantiations of device 12, overhead drones, and/or an electronic device, such as a mobile phone (not shown) carried by user 18, using one or more wireless interfaces/protocols such as, for example, 802.11 (Wi-Fi), 802.15 (including Bluetooth™), 802.15 (Wi-Max), 802.22, Cellular standards such as CDMA, CDMA2000, WCDMA, GSM, Radio Frequency (e.g., RFID), Infrared, Ultra-Wideband, Near Field Magnetics, etc. In one embodiment, transceiver 56 allows the electronic device connect/tether to network using wireless local area network (WLAN) or hotspot. An example of the electronic device carried by user 18 includes, but not limited to, a mobile phone, remote controller, game type controller, a thumb throttle, wrist strap with knobs, a waterproof touch screen, a Bluetooth or Ultra-Wideband tracker, etc. The electronic device can provide capability for transceiver 56 to determine distance and direction to it.

Optionally, device 12 includes other sensors (not shown) such as proximity sensors, optical sensors, video or photo sensors, infrared sensors, temperature sensors, collision avoidance sensors, and the like, or a combination thereof. Other sensors work either as standalone sensors or in conjunction with location sensor 50 and/or position sensor 52 depending on the need.

Device 12 can leverage the sensors, network, data, interface devices, and other capabilities of devices it is connected to wirelessly, such as a personal mobile device carried by user 18, base stations, drones, additional instantiations of device 12, etc.

Figure 5:
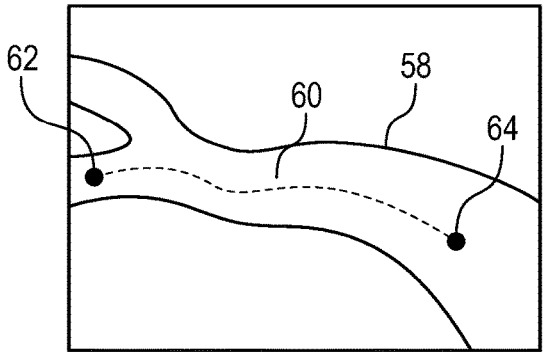
FIG. 5 illustrates a path defined for the device, in accordance with one embodiment of the present invention.

In operation, user 18 determines a path for device 12 along the water stream or body of water. FIG. 5 shows an exemplary steam 58 within which a path 60 is defined for device 12 to travel from a first point 62 i.e., starting point and a second point 64 i.e., end point. In one example, user 18 utilizes display 42 to define path 60 from first point 62 to second point 64. Optionally, user 18 uses the electronic device carried by him/her to define path 60 from first point 62 to second point 64 and transmits the information via transceiver 56 to device 12. Here, path 60 is defined using the location obtained from location sensor 50.

After defining path 60, cable 20 is connected to hook 29 and watercraft 16, as shown in FIG. 1, for example. Propulsion system 32 is activated to provide thrust such that device 12 travels in path 60 defined by user 18 and pulls or tows watercraft 16. In one example, user 18 defines path 60 such that first point 62 location is set as "home" and second point 64 is set as a predefined place on the body of water. Here, user 18 provides an instruction such as "return to home" to device 12 using his/her electronic device. Upon receiving the instruction, device 12 begins travel by controlling the direction of thrust using motor(s) 36 and tows watercraft 16 in the direction of first point 62 until device 12 reaches first point 62.

In one example, user 18 uses the personal mobile device carried by him/her to operate device 12. By leveraging the electronic device, device 12 obtains access to the sensors, wireless network and capabilities of the electronic device. In particular, device 12 interfaces with the incorporated GPS, mapping system, social network, apps, wireless network, camera, processing resources, and other systems present on a set of user mobile devices. This enables device 12 to be simpler, provide easy to configure networking, provide multiuser capabilities such as location sharing, route following, congregating, safety alerts, etc. The personal mobile device may be used either actively while in the user's hand or passively while stored inside device 12. Capabilities of device 12 may be used to interface and interact with the personal mobile device—through the touch screen on lid 24, a remote waterproof touchscreen, audio commands, wireless communication, etc.

In one implementation, two or more cables 20 are provided to pull or push watercraft 16 via device 12 (mechanical drive mode). For example, two cables 20 are tied to each side of device 12, both going back to towed watercraft 16. Here, the relative lengths of the two cables 20 are changed to change the thrust vector of device 12 in water 14.

Figure 6:
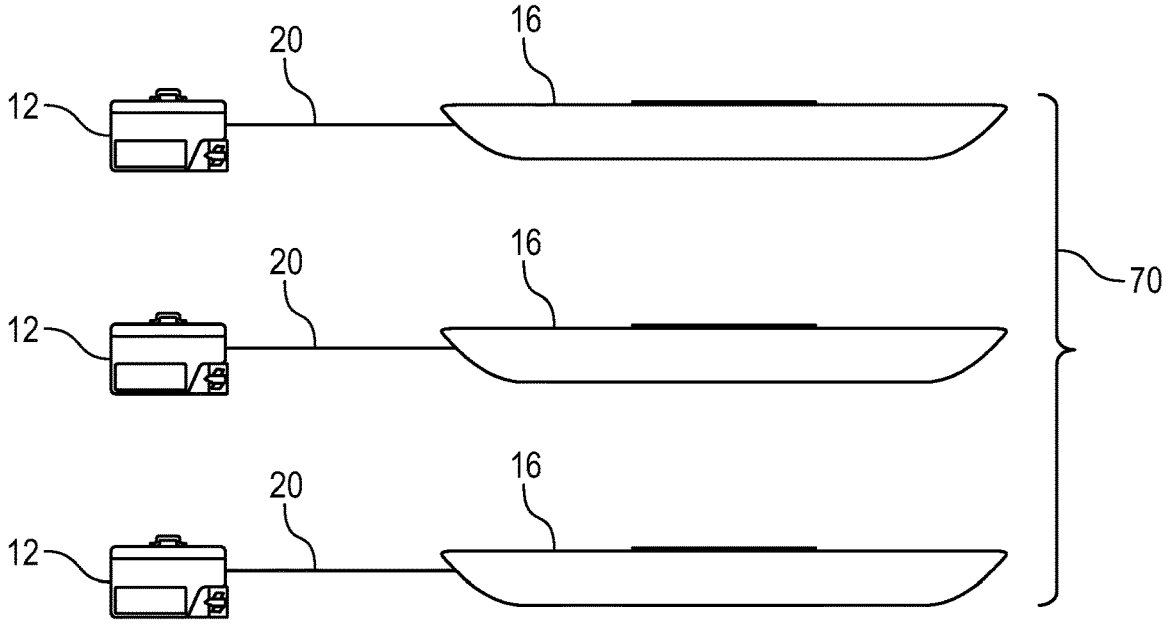
FIG. 6 illustrates a group of devices performing synchronized manoeuvre, in accordance with one embodiment of the present invention.

In another embodiment, a group of devices 70 comprising two or more devices 12, each connecting a watercraft 16 are controlled using the electronic device. Here, user 18 provides instructions to group of devices 70 to perform same or different manoeuvres along the same or different travel paths 60. Consider user 18 provides a synchronized manoeuvre instruction, say travel in the same path 60 as shown in FIG. 6. Here, the group of devices 70 travel in the same direction and pull watercrafts 16 along the defined path 60. Upon reaching the destination, cables 20 are retracted into container 22.

When device 12 is towing watercraft 16, device 12 employs one or more sensors to detect obstructions or objects in its path 60. Subsequently, device 12 employs the collision avoidance sensors and manoeuvres to avoid collision with the objects in its path 60. Optionally, device 12 controls the speed of motors 36 by managing the thrust to stop, circle, return to last known location, etc. In case cable 20 gets detached from device 12 indicating that watercraft 16 has separated from device 12, then device 12 stops, circles and returns to reconnect with watercraft 16.

In one alternate embodiment, more than one device 12 can be used in conjunction with a single watercraft 16. This enables the group of devices to provide better control over the orientation or direction of the watercraft, to provide combined additional thrust, and/or combine the capabilities of each individual device and/or its sensors.

In one alternate embodiment, watercraft 16 or its user 18 can have attached to it a wireless device such as a bluetooth or ultra-wideband tracker or other wireless emitter, that facilitates device 16 determining its location and orientation to the watercraft. Watercraft 16 can have identifying information that can be detected by device 12 visually using photo or video sensors. This enables device 12 to better determine the orientation of the towed or pushed watercraft, to locate the craft or user if it gets separated, to return and reconnect to the craft and/or user.

Figure 7:
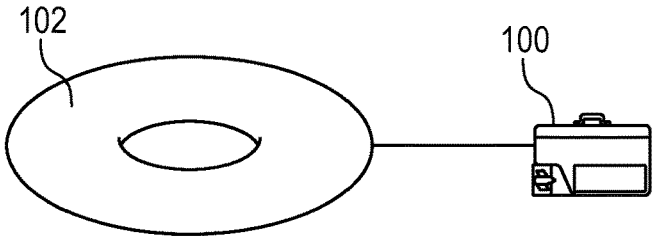
FIGS. 7 and 8 illustrate a device towing a watercraft and storing deflated watercraft therein, respectively, in accordance with another embodiment of the present invention.
Figure 8:
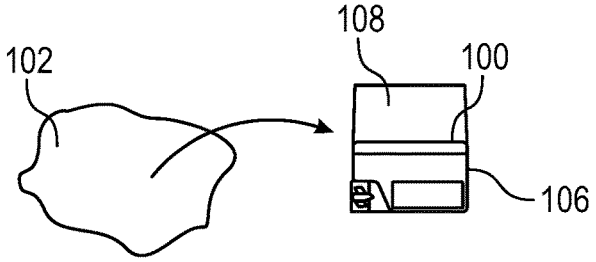

In one alternate embodiment, a device 100 (similar to device 12) is used with a watercraft 102, as shown in FIG. 7. Here, watercraft 102 includes an inner tube. As explained above, device 100 includes a container 106 and a lid 108. Lid 108 opens up to provide access to container 106, as shown in FIG. 8. In the present embodiment, device 100 tows inflated watercraft 102 from one location to another as explained above. When not in use, watercraft 102 is deflated and lid 108 is opened/lifted to store the deflated watercraft 102 in device 100. Further, the user carries device 100 using a handle (not shown).

Based on the above, it is evident that the presently disclosed device is used as a towing apparatus for towing watercrafts on rivers, lakes or other water bodies. The device is capable of towing the watercraft at desired speed along a desired path. The device includes a propulsion system to provide thrust force when traveling slowly. The device is stable in the water while providing a large amount of thrust to a slow moving object, i.e., watercraft with or without the user on it. While on the watercraft, the user can stand and perform a variety of activities such as photography, eating, communicating, etc.

A person skilled in the art appreciates that the device may come in a variety of shapes and sizes depending on the need and comfort of the user. Further, many changes in the design and placement of components may take place without deviating from the scope of the presently disclosed device.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. A device for towing a watercraft, the device comprising:

a container, said container comprises an interior;

a watercraft, wherein said watercraft connects at an outer surface of said container; and a propulsion system, wherein said propulsion system positions underneath said interior, wherein said propulsion system comprises:

an intake channel;

an exhaust pipe; and a propulsion member, wherein said propulsion member protrudes backwards and positions outside of said container, wherein said propulsion member rotates and keeps said device stable in water, wherein said propulsion member connects to said intake channel and said exhaust pipe, wherein said propulsion member draws the water through said intake channel and pumps out the water via said exhaust pipe, and wherein said propulsion member exerts linear thrust upon the water such that said container moves forward or backward and tows said watercraft; and a transceiver for receiving instructions wirelessly from an electronic device for operating said device.

2. The device of claim 1, wherein said container comprises a lid, wherein said lid removably positions over said container, and wherein said lid connects to said container via a hinge.

3. The device of claim 2, wherein said lid comprises a seal, wherein said seal covers a gap between said lid and said container and prevents the water from entering said interior.

4. The device of claim 2, wherein said lid comprises a latch to lock and unlock said lid over said container.

5. The device of claim 2, wherein said lid is transparent allowing a user to see through contents in said interior.

6. The device of claim 1, wherein said interior comprises a battery, and wherein said battery powers said propulsion member to maneuver over the water.

7. The device of claim 2, wherein said lid comprises a handle for carrying said device.

8. The device of claim 2, wherein said lid comprises a display to control operation of said device.

9. The device of claim 8, wherein said display configures to define a path for said device to travel over the water.

10. The device of claim 9, wherein said device further comprises an obstruction detection sensor and a collision avoidance system, wherein said obstruction detection sensor detects objects in said path, and wherein said collision avoidance system maneuvers said device to avoid collision with said objects.

11. The device of claim 1, wherein said watercraft connects to said container via a cable.

12. The device of claim 11, wherein said propulsion system stops thereby not generating thrust on the water upon detecting said cable is detached from said container.

13. The device of claim 1, further comprises a location sensor, wherein said location sensor determines a location of said device.

14. The device of claim 13, further comprises a position sensor, wherein said position sensor determines a direction or an orientation of said device.

15. The device of claim 1, wherein said watercraft includes an inner tube, and wherein said inner tube deflates when not in use, folds and positions in said interior.

16. The device of claim 1, wherein said watercraft allows a user to sit or stand while being towed by said container.

17. A method of towing a watercraft, said method comprising:

providing a container having an interior;

providing a watercraft connecting at an outer surface of said container;

providing a propulsion system, said propulsion system positioning underneath said interior;

providing an intake channel, an exhaust pipe and a propulsion member in said propulsion system, said propulsion member protruding backwards and positioning outside of said container;

connecting said propulsion member to said intake channel and said exhaust pipe;

drawing water through said intake channel and pumping out the water via said exhaust pipe by said propulsion member; and exerting linear thrust upon the water by said propulsion member for keeping said device stable in the water and moving said container forward or backward in order to tow said watercraft; and receiving instructions wirelessly via a transceiver from an electronic device for operating said device.

18. The method of claim 17, further comprising:

defining a path for said device to travel on the water;

providing an obstruction detection sensor for detecting objects in said path; and providing a collision avoidance system for maneuvering said device to avoid collision with said objects.

19. A watercraft towing system, comprising:

at least one towing device further comprising:

a container, said container comprises an interior compartment for holding items to be conveyed by said watercraft towing system;

a watercraft, wherein said watercraft connects at an outer surface of said container; and a propulsion system;

a controller associated with said at least one towing device, said controller providing control signals for operating and controlling said propulsion system;

said controller further comprising a wireless communication circuit for wireless communication with said propulsion system;

at least one wireless device controllably receiving and processing said wireless communication from said controller, said wireless communication circuit selected from the group consisting of a personal mobile communication device, and at least one wireless tracker comprising sensors, wireless network and services including GPS, mapping system, social network, apps, wireless network, camera, and processing resources;

said at least one wireless device configured to selectively receive and process said wireless communication from said towing device controller, said at least one wireless device located either within said container or within said watercraft;

at least one processing and sensing system for use with said controller and said at least one wireless device for determining a relative orientation between said watercraft and said container; and further wherein said controller and said wireless device operate collaboratively to steer said watercraft in a desired direction.

20. The device of claim 1, further comprising a wired interface for receiving instructions from an electronic device for operating said device.

21. The method of claim 17, further comprising receiving instructions via a wired interface from an electronic device for operating said device.

* * * * *